US007469791B2

(12) United States Patent
Phoy

(10) Patent No.: US 7,469,791 B2
(45) Date of Patent: Dec. 30, 2008

(54) DISPLAY RACK WITH SLIDABLE CHANNEL TRAYS

(76) Inventor: Sung Ho Phoy, Gangsun Hanshin Apartment 304-1102, Juyup 1-dong, Ilsan-gu, Goyang-si, Gyeonggi-do, 411-371 (KR)

( * ) Notice: Subject to any disclaimer, the term of this patent is extended or adjusted under 35 U.S.C. 154(b) by 428 days.

(21) Appl. No.: 11/200,888

(22) Filed: Aug. 10, 2005

(65) Prior Publication Data

US 2006/0032827 A1 Feb. 16, 2006

(30) Foreign Application Priority Data

Aug. 13, 2004 (KR) ..... 10-2004-0063883

(51) Int. Cl.
*A47F 1/04* (2006.01)

(52) U.S. Cl. ..... 211/59.2

(58) Field of Classification Search ..... 211/59.2, 211/126.15, 94.01, 162, 151, 175, 187, 126.1; 312/35, 72, 73, 334.27, 334.28, 334.32, 334.34
See application file for complete search history.

(56) References Cited

U.S. PATENT DOCUMENTS 1,607,847 A * 11/1926 Reitzel ..... 312/334.32
2,282,247 A * 5/1942 Reid ..... 312/334.27
3,975,071 A * 8/1976 Quinn ..... 312/323
4,653,818 A * 3/1987 DeBruyn ..... 312/246
4,724,968 A 2/1988 Wombacher
4,762,236 A 8/1988 Jackle, III et al.
4,923,070 A * 5/1990 Jackle et al. ..... 211/59.2
5,012,936 A 5/1991 Crum
5,024,336 A 6/1991 Spamer
5,050,748 A 9/1991 Taub
5,111,942 A * 5/1992 Bernardin ..... 211/59.3
5,123,546 A * 6/1992 Crum ..... 211/59.3
5,230,554 A * 7/1993 Camilleri ..... 312/334.6
5,330,063 A * 7/1994 Remmers ..... 211/162
5,363,774 A * 11/1994 Anada et al. ..... 108/143
5,366,099 A 11/1994 Schmid
5,439,122 A * 8/1995 Ramsay ..... 211/187
5,458,248 A 10/1995 Alain
5,531,336 A 7/1996 Parham et al.
5,645,176 A 7/1997 Jay
5,671,987 A * 9/1997 Hommes ..... 312/334.23
5,673,801 A * 10/1997 Markson ..... 211/59.3
5,855,283 A * 1/1999 Johnson ..... 211/59.3
5,944,201 A * 8/1999 Babboni et al. ..... 211/151
6,485,120 B1 * 11/2002 Pomerleau et al. ..... 312/334.27
6,523,702 B1 * 2/2003 Primiano et al. ..... 211/59.2
6,615,995 B2 * 9/2003 Primiano et al. ..... 211/59.2

(Continued)

*Primary Examiner*—Jennifer E. Novosad
(74) *Attorney, Agent, or Firm*—Cantor Colburn LLP

(57) ABSTRACT

A display rack comprises a plurality of display rack modules connected with each other laterally side-by-side to be fixed on wire shelves in a display case. A display rack module comprises a channel base secured on a wire shelve of a display case, and a channel tray mounted slidably on the channel base. The channel tray has a pair of guide grooves along the longitudinal sides of the bottom, a front stopper and a rear stopper formed between the pair of guide grooves. The channel base has a pair of L shaped longitudinal projections on the upper surface to be slidably engaged with the guide grooves, and has at least a stopper at the front of the upper surface, which contacts the front stopper in displaying mode and contacts the rear stopper in refilling mode.

6 Claims, 12 Drawing Sheets

U.S. PATENT DOCUMENTS 6,659,293 B1 * 12/2003 Smith ..... 211/59.2
6,779,670 B2 * 8/2004 Primiano et al. ..... 211/74
6,843,382 B2 * 1/2005 Kanouchi et al. ..... 211/90.02
6,866,352 B2 * 3/2005 Fujii et al. ..... 312/122
7,237,686 B2 * 7/2007 Bertrand et al. ..... 211/74

* cited by examiner

DISPLAY RACK WITH SLIDABLE CHANNEL TRAYS

PRIORITY

This application claims priority from the Korean Patent Application No. 2004-0063883, filed on Aug. 13, 2004, which is fully incorporated herein by reference.

BACKGROUND

1. Field of the Invention

The present invention relates to display racks for supporting and displaying canned, packed or bottled beverages in a display case or showcase.

2. Description of the Related Art

Generally, a display case or showcase is used for displaying bottles, cans or packs of liquors, beverages or foods (referring to "articles" hereinafter) at the point of sale.

Such a display case or showcase, especially for refrigerated displays (referring to "display case" hereinafter) has a plurality of shelves or floors on each of which a display rack is installed fixedly. A display rack has a plurality of channels laterally side-by side for accommodating and displaying articles therein. Generally the shelves or floors are made of wires in order to simplify the inner structure and to facilitate refrigerating efficiency in the display case. A gravity fed type of the display case refers to a display case having inclined shelves or floors so that articles in the channel of the display racks move forwardly under the influence of gravity as the lead article is removed from the channel.

It is desirable in refilling channels of a display rack that the already displayed old articles are positioned toward the front of the display racks and the fresh or new articles are behind the old articles. However, it is difficult to refill the articles by putting them behind the old articles in the rear of each channel because of the narrow space between the display racks and between the channels of a display rack in a display case. Accordingly, refilling the new articles behind the old articles requires removal of all the old articles in the channels of the display racks. This is, of course, a very time consuming operation. Under such circumstances, the new articles are usually refilled into the front of the channels of the display racks by pushing the old articles backward. This causes the old articles in the rear of the channels to continue to remain in the rear of the channels of the display rack without being retrieved upon each refilling.

Accordingly, it is an object of the present invention to provide a display rack having a plurality of channels laterally side-by side in which each of channels can be slid forwardly out of the display rack so that the new articles are refillable behind the old articles.

It is another object of the invention to provide a display rack module which constitutes one channel of a display rack, a plurality of which are connected with each other laterally side-by side to form a display rack with independently slidable channel trays.

It is further object of the invention to provide a display rack which has stopper means to secure the slidable channel trays on the display rack in displaying mode and to limit the traveling distance of the channel tray out of the display rack and secure the channel tray in refilling mode.

SUMMARY OF THE INVENTION

The present invention provides a display rack including at least one common base which is secured on shelves or floors of a display case, and a plurality of channel trays which are mounted slidably on the common base(s), so that each of the channel trays can be slid out of the display rack at the time of refilling new articles.

The present invention also provides a display rack comprising a plurality of display rack modules connected laterally side-by-side wherein a display rack module comprises a channel base secured on a wire shelf of a display case and a channel tray which is mounted slidably on the channel base, so that each of the channel trays can be slid out of the channel bases at the time of refilling new articles.

Further, the present invention provides a display rack and a display rack module including various stopper means to limit the traveling distance of the channel tray on the channel base and/or on the common base and secure the channel tray on the channel and/or the common base at the time of refilling new articles.

BRIEF DESCRIPTION OF THE DRAWINGS

The above objects and other advantages of the present invention will become more apparent by describing in detail the preferred embodiments thereof with reference to the attached drawings in which.

DETAILED DESCRIPTION OF THE PREFERRED EMBODIMENT

The present invention is explained hereinafter on the basis of modular construction in the preferred embodiments. Generally, a display rack has a plurality of channels to be partitioned laterally side-by-side. In the modular construction, a display rack comprises a plurality of display rack modules connected with each other laterally side-by-side.

Embodiment 1

Figure 1:
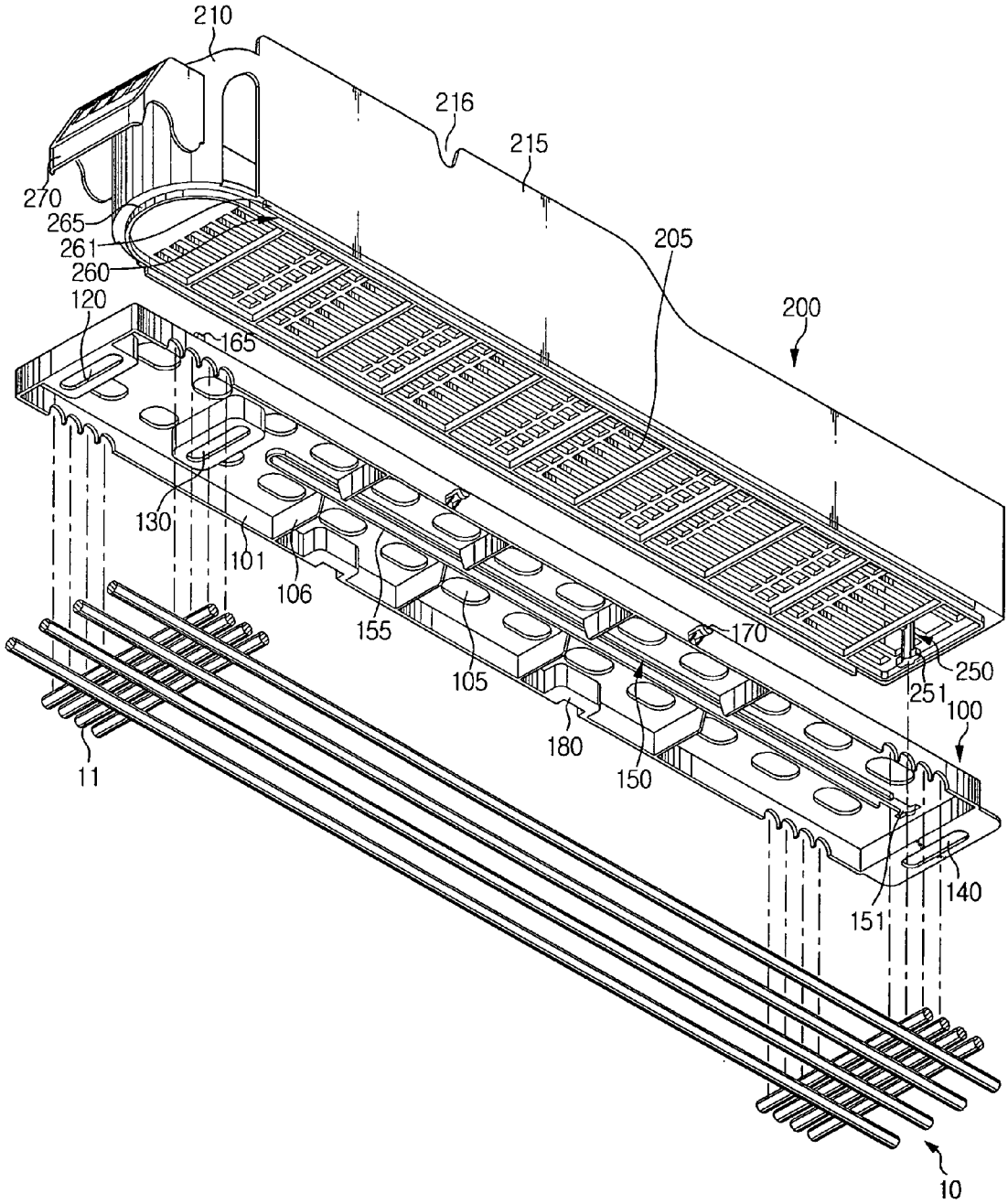
FIG. 1 is a perspective view of a disassembled display rack module according to the first embodiment of the present invention with a fragmentary wire shelf of a display case.
Figure 2:
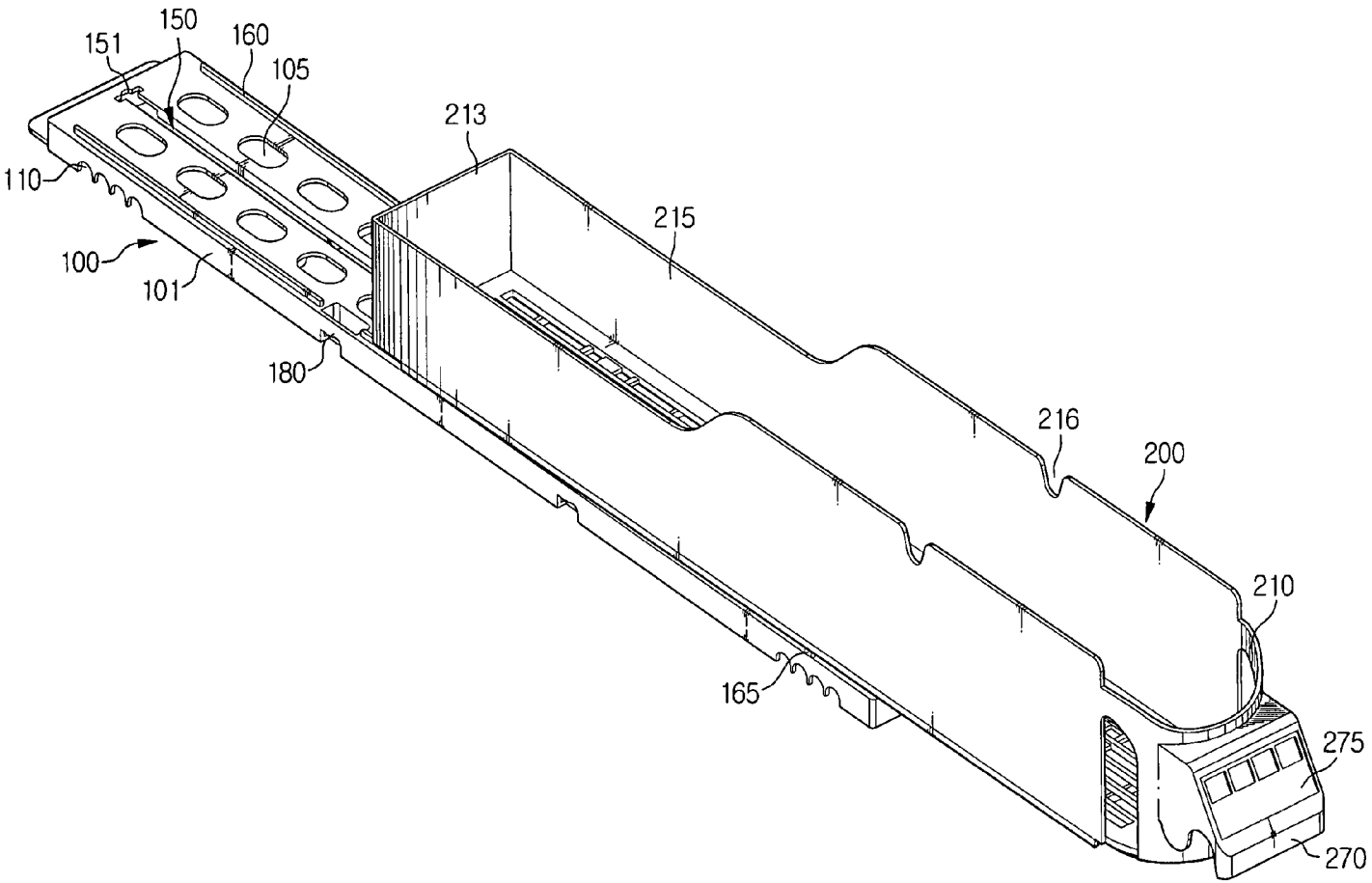
FIG. 2 is a perspective view of an assembled display rack module according to the first embodiment of the present invention.

FIG. 1 shows a display rack module according to the present invention comprising a channel tray 200 and a channel base 100 together with a fragmentary wire shelf 10 of a display case and FIG. 2 shows a channel tray 200 mounted on a channel base 100 with the channel tray 200 partly slid out from a channel base 100.

As shown, the display rack module according to the present invention comprises a channel base 100 and a channel tray 200. The channel base 100 may be secured by conventional fasteners such as bolts and nuts or by using other conventional fixing method on the wire shelf 10 which is firmly installed in the display case (not shown). The channel tray 200 is mounted slidably along the channel base 100 so that the channel tray 200 can be slid forwardly from the channel base 100 and/or can be returned onto the channel base 100 without being disassembled from the channel base 100.

For illustrating a method for fixing the channel base 100 on the wire shelf 10, it is shown that the channel base 100 has a plurality of semicircular grooves 110 on its side members 101 so that the grooves 110 fit onto the lateral wires 11 of the wire shelf 10. The grooves 110 facilitate securing the channel base 100 on the wire shelf 10. Then, the channel base 100 is fixed on the wire shelf 10 by inserting bolts into the bolt holes 120 and 140 formed in the front and rear end of the channel base and fastening nuts under the wire shelf 10. Other conventional fasteners instead of the bolts and nuts are also applicable. The number and shape of grooves 110 as shown in FIG. 1 is for illustrational purpose and may be modified or cancelled according to the construction of the shelf 10. Lateral wire(s) 11 may be formed on the outer periphery only or formed crosswardly with the longitudinal wires at the front and/or middle and/or rear portion of the longitudinal wires in the shelf 10. Therefore, the grooves 110 may be formed selectively by considering the positioning of the lateral wires of the shelf 10.

Further, when the channel tray 200 is slid forwardly, the displaced weight center of the channel tray 200 creates substantial bending moments to the stationary channel base 100 to deform the channel base 100. For preventing such deformation, additional bolt hole 130 is preferably formed behind the front bolt hole 120 at the front portion of the channel base 100. A plurality of holes formed on the bottom plate of the channel base 100, as clearly shown at FIG. 1, are vent holes 105 for the cool air to flow through the display rack.

The sliding structure of the display rack module is explained with reference to the FIGS. 1 and 3. The channel base 100 has an elongate guide slot 150 along its longitudinal center line, into which a protrusion 250 of the channel tray 200 is slidably engaged therethrough. The protrusion 250 is protruded downwardly from the bottom plate of the channel tray 200 and has an enlarged head 251 at its free end. The elongate guide slot 150 has an insertion hole 151 at the rear end, into which the enlarged head 251 of the protrusion 250 is inserted to be engaged with the elongate guide slot 150. The elongate guide slot 150 has a pair of guide protrusions 155 depending downwardly from both longitudinal sides of the elongate guide slot 150. When the enlarged head 251 is inserted into the insertion hole 151 and the channel tray 200 is pulled out a little forwardly, the enlarged head 251 contacts the guide protrusions 155. In order to make their assembly easy, the guide protrusions 155 are formed a little apart from the inserting hole 151. Further, as shown clearly in FIG. 1, a plurality of lateral reinforcement members 106 are formed from the guide protrusions 155 to the side members 101 of the channel base 100 for reinforcing rigidity of the channel base 100.

Figure 3:
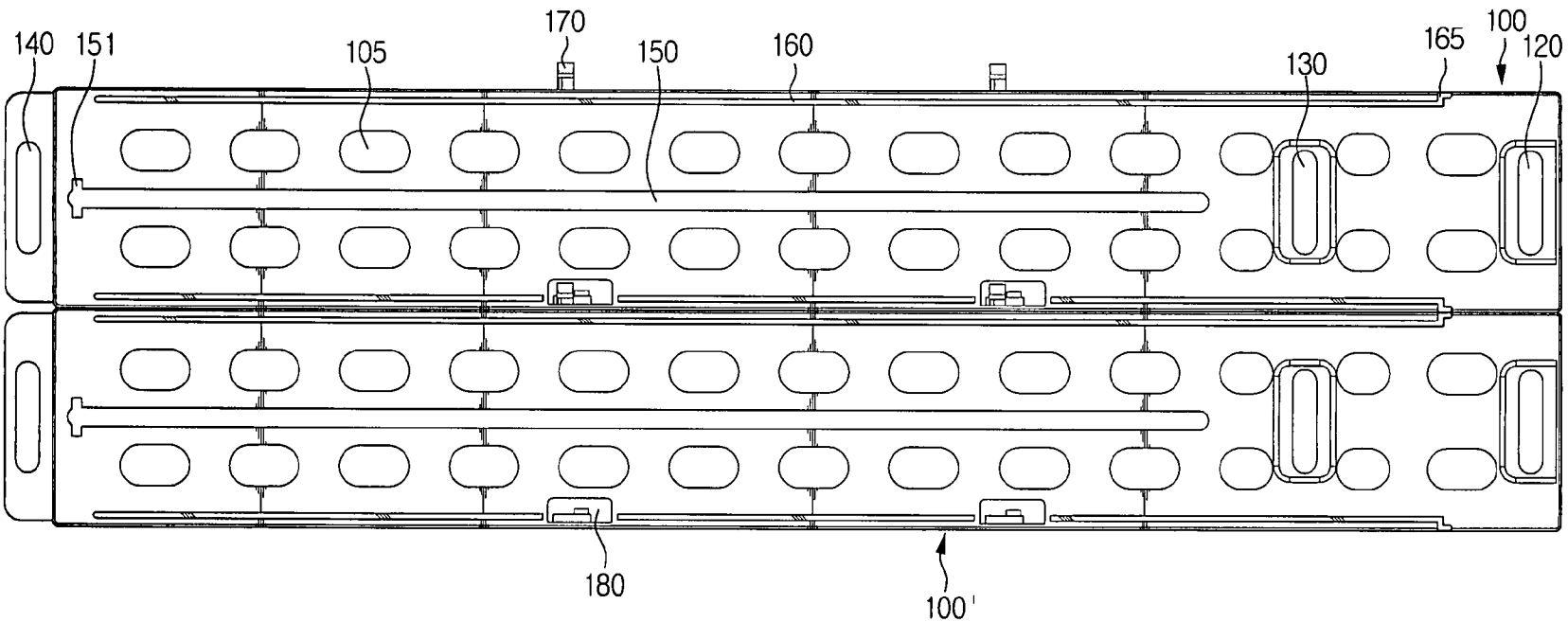
FIG. 3 is a top plan view of the two interlocked channel bases.

As shown in FIG. 3, a pair of guide rails 160 are formed to be protruded upwardly adjacent both longitudinal side end portions on the upper surface of the channel base 100. The guide rails 160, which are mated with guide grooves 260, are for supporting the channel tray 200 stably on the channel base 100. Abutment stops 165 are formed vertically from the front end of the guide rails 160 toward the longitudinal side end portions of the channel base 100. Front ends 261 of guided groove 260 of the channel tray 200 abut the abutment stops 165 when the channel tray 200 is mounted on the channel base 100 so as to prevent the channel tray 200 from being slipped out of the channel base 100 in gravity fed type of the display case. Referring to FIGS. 1 and 3, the channel bases 100 have keys 170 and key-holes 180 at their opposite side members for connecting a plurality of channel bases 100 laterally side-by-side to form a display rack.

Referring to FIGS. 1 and 2, the channel tray 200 is explained. The channel tray 200 comprises a front wall 210, a rear wall 213, two parallel side walls 215 and a bottom plate which is mounted slidably on the channel base 100. However, the rear wall 215 of the channel tray 200 may be omitted in case of the gravity fed type of the display case in which the articles would not be dropped out from the rear end. The bottom plate has a plurality of vent holes 205 for allowing cool air to flow therethrough.

As explained above in relation to the channel base 100, the channel tray 200 has a protrusion 250 having an enlarged head 251 at its free end, which is extended vertically and downwardly from the rear portion of the bottom plate of the channel tray 200. The protrusion 250 is mated with and is slidable along the elongate guide slot 150 of the channel base 100. The protrusion 250 has an enlarged head 251 having two lateral wings to be inserted into the insertion hole 151. When the channel tray 200 is drawn a little forwardly after inserting the enlarged head 251 into the insertion hole 151, two wings of the enlarged head 251 contact the guide protrusions 155 of the channel base 100, so that a display rack module is assembled.

Further, the channel tray 200 has a pair of guide grooves 260 opened downwardly along both longitudinal side end portions on the bottom plate, which are mated slidably on the guide rails 160 of the channel base 100. A guide groove 260 comprises an outer linear member 261 preferably extended downwardly from the side wall 215 and an inner member 265 which depends from the bottom surface, wherein both members 261 and 265 have a space therebetween for mating with the guide rail 160 slidably. The inner members 265 may be formed continuous with connection arc as a single member as shown in FIG. 1 or may be formed as two linear members similar to the outer linear members 261. The outer and inner members 261 and 265 form the guide groove 260 which mates with the guide rail 160 slidably to enable the channel tray 200 to slide stably on the channel base 100.

Of course, the guide rail may be formed on the bottom surface of the channel tray 200 and the guide groove may be formed on the upper surface of the channel base 100 in optional variations.

The front wall 210 of the channel tray 200 has a knob 270 used for drawing the channel tray 200 out of the channel base 100. The knob 270 may have a recess on its frontal surface on which a label(s) 275 for trademark and/or price of articles is attached. Further, a pair of holes to show the lead article may be formed beside the knob 270. And the frontal wall 210 may have a contour corresponding to the article. In order that substantial portion of the lead article can be viewed to a potential customer, the knob 270 may be formed at the lower portion or bottom of the front wall and most of upper portions of the front wall above the knob 270 may be cut out. Opened front wall having transversely extending lips will be explained in detail in relation to Embodiment 3.

Each of the side walls 215 of the channel tray 200 may have a key groove 216 at the top, respectively which may be used conveniently for storing and transporting the display rack module. The key 170 of the channel base 100 is inserted into the key groove 216 of the channel tray 200 when the display rack modules are stored or transported, so that the channel tray 200 can be prevented from being deformed during being stored and transported.

The channel base 100 and the channel tray 200 of the display rack module, which are preferably an integral, one-piece, unitary construction formed in a single plastic molding operation, respectively, may be produced in various widths in accordance with articles. FIG. 3 shows two interlocked channel bases 100 and 100'. A plurality of display rack modules are connected by interlocking the channel bases 100 laterally side-by-side to form a display rack which is fixed on a shelf 10 of the display case. A display rack may be formed by interlocking channel bases of different widths for supporting and displaying different articles on the display rack. Further, a common base (not shown) may be used instead of individual channel bases 100 and 100'. A common base may be constructed to incorporate two or more channel base 100 and 100'. Even a common base may incorporate all the channel bases needed to comprise a display rack.

The display rack modules are installed and maintained in the display case or showcase as follows:

Firstly, display racks are constructed in situ by connecting appropriate numbers of channel bases 100 and/or a common base(s) corresponding to the width of a shelf or a floor of the display case. The interlocked channel bases 100 and/or a common base(s) are fixed on the shelf 10 by fastening bolts or screws into fastening holes 120, 130 and 140. Then, the channel trays 200 are mounted on the channel bases 100 and/or a common base(s) by inserting the enlarged head 251 of the protrusion 250 of the channel tray 200 into the inserting hole 151 of the elongate guide slot 150 and drawing the channel tray 200 forwardly till the front ends of the outer linear member 261 of the channel tray 200 abut the abutment stops 165 of the guide rail 160 of the channel base 100 so that two wings of the enlarged head 251 contact the guide protrusions 155 of the channel base 100 and the guide groove 260 of the channel tray 200 is mated on the guide rail 160 of the channel base 100. However, the channel trays 200 may be mounted on the interlocked channel bases 100 and/or a common base(s) before installing the display racks on the shelves or floors. Alternatively the display rack modules may be assembled firstly and then are connected with each other to form display racks before installing the display racks on the shelves or floors of the display case.

The channel tray 200 with stocked articles is prevented from being dropped out of the inclined shelves even in a display case of gravity fed type by the abutment stops 165 supporting the outer linear members 261 of the channel tray 200 at the displaying mode. When a lead article is taken out by a customer, the articles move forwardly by influence of the gravity in the display case of gravity fed type. Upon refilling the new articles, the front of the channel tray 200 should be raised up by lifting up and pulling out the knob 270 so that the outer linear members 261 of the guide groove 260 go over the abutment stops 165. Then the channel tray 200 can be slid forwardly from the display case by drawing the channel tray 200 out of the channel base 100 till the protrusion 250 contacts the front end of the elongate guide slot 150, in which the enlarged portion 251 is supported on the linear protrusions 155 of the elongate guide slot 150 to prevent the channel 220 from being dropped out of the channel base 100. In the refilling mode, new articles can be refilled behind the old articles. After refilling, the channel tray 200 is returned back on the channel base 100 for the displaying mode by pushing the knob 270 backwardly till the front end of the outer linear members 261 moves behind the abutment stops 165.

Embodiment 2

Embodiment 1 is applicable to a display rack for articles not too heavy to be stocked in a channel tray 200. However, when articles to be stocked in a channel are too heavy, the channel base 100 may be deformed or broken owing to the elongate guide slot 150 or the enlarged portion 251 of the protrusion 250 may be broken by substantial moment of the channel tray 200 with articles on refilling mode especially in case of a long channel.

Accordingly, a display rack module for displaying many heavy articles needs more rigid structure and sliding mechanism. Embodiment 2 and 3, as shown FIGS. 4 to 11, provide more rigid types of a display rack module.

Embodiment 2 improves slidable mating structure between the channel base 100 and the channel tray 200 of the Embodiment 1 only. Therefore, descriptions are omitted for vent holes 305, bolt holes 320 and 330, keys 370 and key-holes 380 of the channel base 300; and vent holes 405, a front wall 410, a rear wall 413, side walls 415, a knob 470 of the channel tray 400 which are substantially identical or similar to the Embodiment 1.

Figure 5:
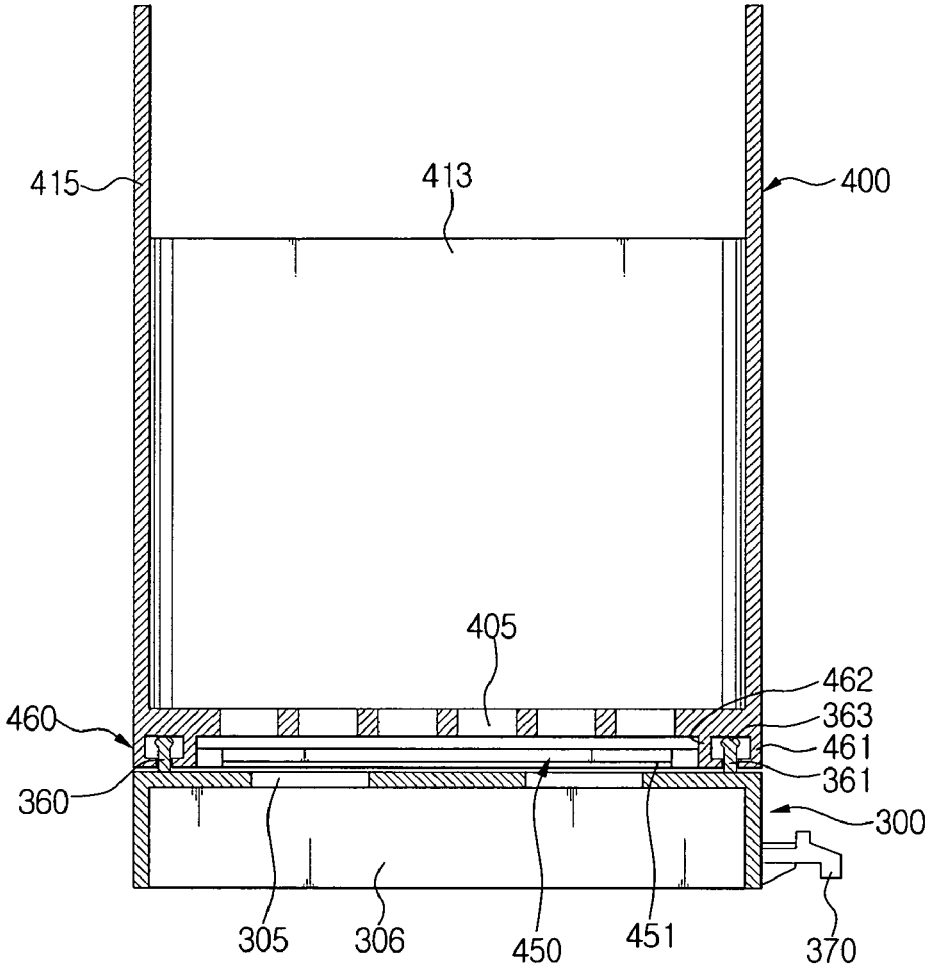
FIG. 5 is a cross sectional view, taken along A-A of FIG. 4.
Figure 7:
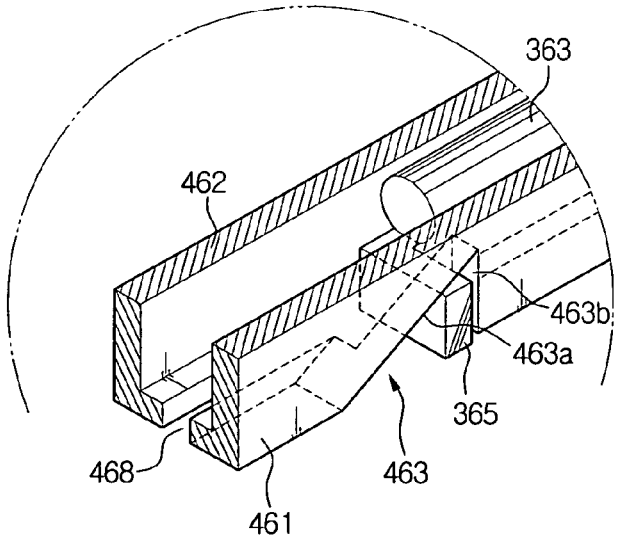
FIG. 7 is a fragmentary perspective view enlarging the circle B of FIG. 6.

Modifications of Embodiment 2 are shown clearly in FIGS. 5 and 7. A pair of guide rails 360 of the channel base 300 have an enlarged rail member 363 on the linear projections 361 of the guide rails 360, respectively and guide grooves 460 of the channel tray 400 comprise a pair of L shaped members 461 and 462 to form a hollow space to hold the enlarged rail member 363 of the channel base 300 therein, respectively. The free ends of L shaped members 461 and 462 face each other to form an elongate slit 468 to be engaged slidably with the linear projection 361 of the channel base 300. The enlarged rail member 363 is formed as quadrilateral, circular, elliptical shape in its cross-section. However, circular or elliptical shape is preferable for reducing friction between the rail member 363 and the bottom surface of the channel tray 400 in the guide groove 460 when the channel tray 400 is slid out on the channel base 300. The L shaped members 461 and 462 support rail member 363 of the channel tray 400 in refilling mode during refilling new articles. Further, the linear projection 361 of the guide rail 360 has a sufficient height for the front ends of the L shaped members 461 and 463 to go over abutment stops 365 of the guide rail 360 when the front of the channel tray 400 is lifted up from the channel base 300.

Figure 6:
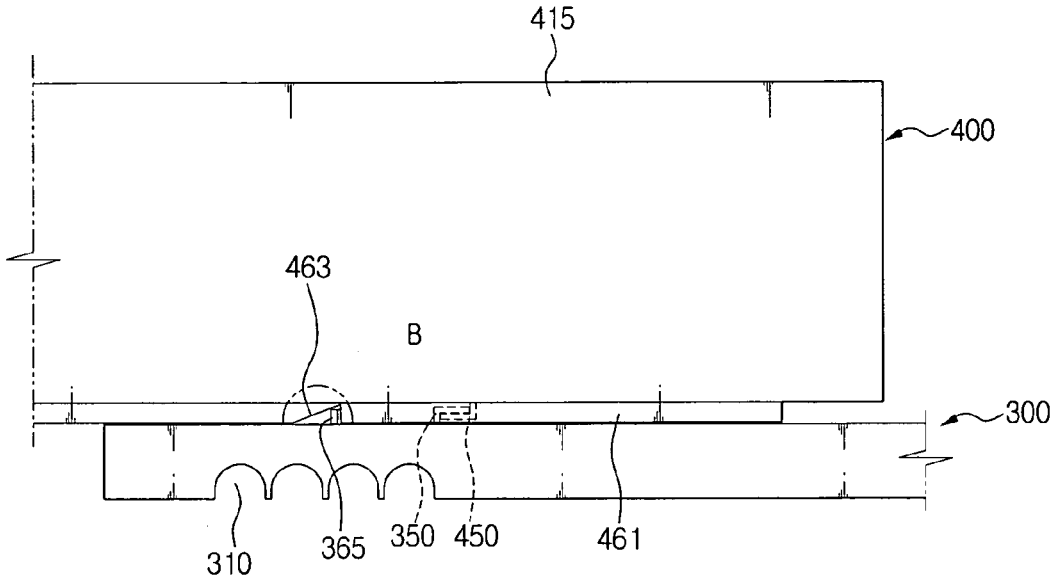
FIG. 6 is a fragmentary side elevational view showing the refilling mode of the display rack module according to the second embodiment of the present invention.

As shown in FIG. 6 and FIG. 7 which is an enlarged perspective view of circle B of the FIG. 6, a supporting groove 463 having a slanted portion 463*a* and a vertical portion 463*b* is formed near the rear end of the outer L shaped member 461 of the guide groove 460. The supporting groove 463 mates with an abutment stop 365 which is extended vertically from the guide rail 360 toward the side end of the channel base 300 when the channel tray 400 is drawn forwardly from the channel base 300 to the refilling mode. The channel tray 400 can be drawn forwardly by lifting up the front of the channel tray 400 a little from the channel base 300. Lifting up of the front of the channel tray 400 makes the front end of the guide groove 460, which has been supported by the abutment stop 365, go over the abutment stop 365. In the refilling mode, the supporting groove 463 mates with the abutment stop 365 with the vertical portion 463*b* abutting the abutment stop 365. The channel tray 400 is tilted down when the supporting groove 463 mates with the abutment stop 365. The slanted portion 463*a* may have gentle slope in order to prevent the sudden falling down of the channel tray 400 to the channel base 300. Accordingly, the traveling distance of the channel tray 400 on the channel base 300 is determined by location of the abutment stops 365 of the channel base 300 and the supporting grooves 463 of the guide grooves 460.

Figure 4:
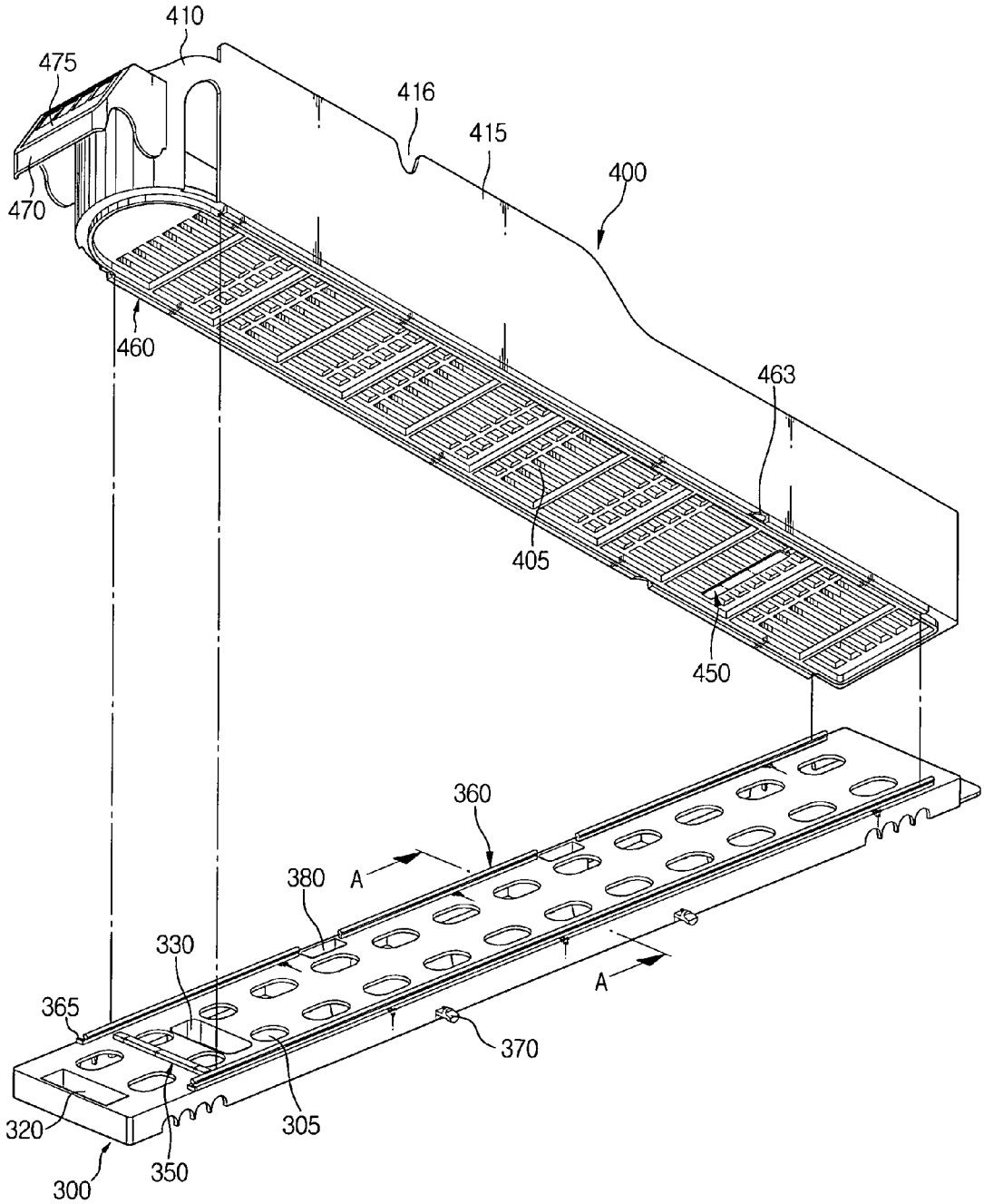
FIG. 4 is a perspective view of a disassembled display rack module according to the second embodiment of the present invention.

Another construction for supporting the channel tray 400 and limiting the traveling distance of the channel tray 400 from the channel base 300 is a stopping member 350 which stands uprightly or slanted backwardly at the frontal portion of the upper surface of the channel base 300, and a latch member 450 which depends vertically or slanted forwardly at the rear portion of the bottom surface of the channel 300. As shown in FIGS. 4 to 6, the stopping member 350 and latch member 480 is formed as a thin plate. However, they may be formed as a thick plate or a trapezoidal cross section bar for reinforcing rigidity of the members 350 and 450. The height of the members 350 and 450 is preferably a height that the stopping member 350 do not contact the bottom surface of the channel 300 and the latch member 450 do not contact the upper surface of the channel base 400. Further, the members 350 and 450 may have a horizontal wing 351 and 451 extended from the free ends of the members 350 and 450, respectively, in which the stopping member 350 has a horizontal wing 351 faced backwardly and the latch member 450 has a horizontal wing 451 faced forwardly to be latched with the horizontal wing 351 of the stopping member 350.

Stopper means for limiting the traveling distance of the channel tray 400 beyond the front end of the channel base 300 described such as either the supporting groove 463 of the guide groove 460 and the stopper 365 of the guide rail 360, or the stopping member 350 of the channel base 300 and the latch member 450 of the channel tray 400 may be adopted selectively in a display rack module. However, both of the stopper means may be used together in a display rack module.

The channel tray 400 is assembled with the channel base 300 by inserting the pair of the guide grooves 460 to the rail members 363 of the guide rails 360 from the rear end of the channel base 300. Then, the channel tray 400 slides to a position where the frontal ends of the guide grooves 460 contact the abutment stops 365 of the guide rails 360 of the channel base 300.

For drawing out the channel tray 400 from the channel base 300 upon refilling the new articles, front of the channel tray 400 should be raised up by lifting up the knob 470 so that the front ends of the guide grooves 460 are released from and go over the abutment stoppers 365. Then the channel tray 400 can be drawn forwardly from the channel base 300. At the fully drawn position of the channel tray 400, the supporting grooves 463 formed at the rear portion of the channel base 300 mate with the abutment stops 365 and the vertical portions 463b abuts the abutment stops 365, and/or the latch member 450 of the bottom surface of the channel tray 400 latches with the stopping member 350 of the channel base 300. The fully drawn channel tray 400 is supported on the channel base 300 by the rear portion of L shaped members 461 and 462 of the guide groove 460 mated with the rail member 361 of the guide rail 360. In the refilling mode, new articles are refilled behind the old articles. After refilling, the channel tray 200 is retracted by pushing the knob 470 backwardly till the frontal ends of the guide grooves 460 move behind the abutment stops 365 in the displaying mode.

Embodiment 3

Embodiment 3 is similar to the construction of Embodiment 2, however, the slidable mating structure between the guide grooves 460 of the channel tray 400 and the guide rails 360 of the channel base 300, the front wall 410 and the knob 470, and the connecting structure between the channel bases 300 are modified from those of the Embodiment 2.

Therefore, explanation of elements which are identical or similar to those in Embodiment 2 is omitted.

FIGS. 8 to 13 show a display rack module according to the Embodiment 3 of the present invention.

Figure 8:
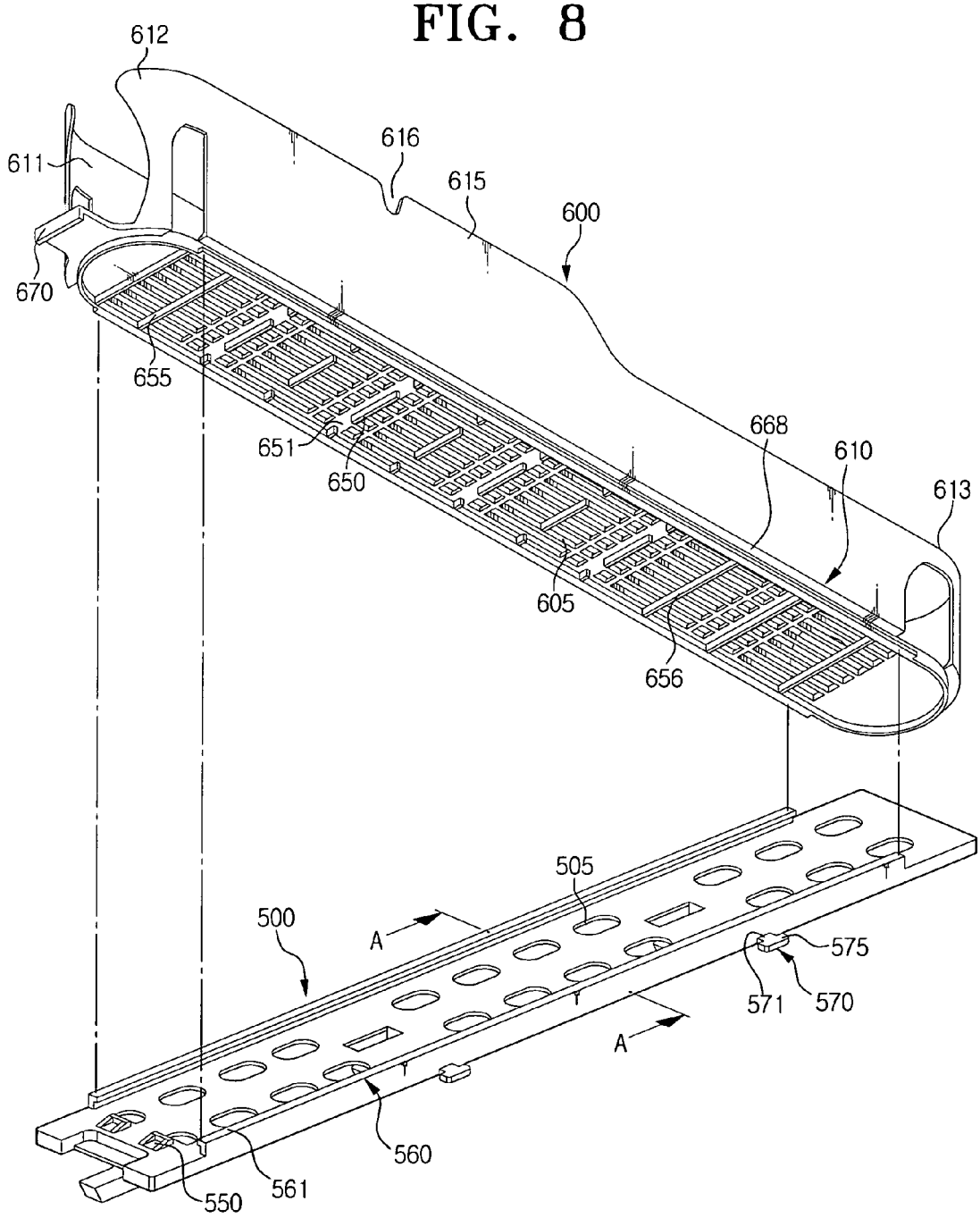
FIG. 8 is a perspective view of a disassembled display rack module according to the third embodiment of the present invention.
Figure 9:
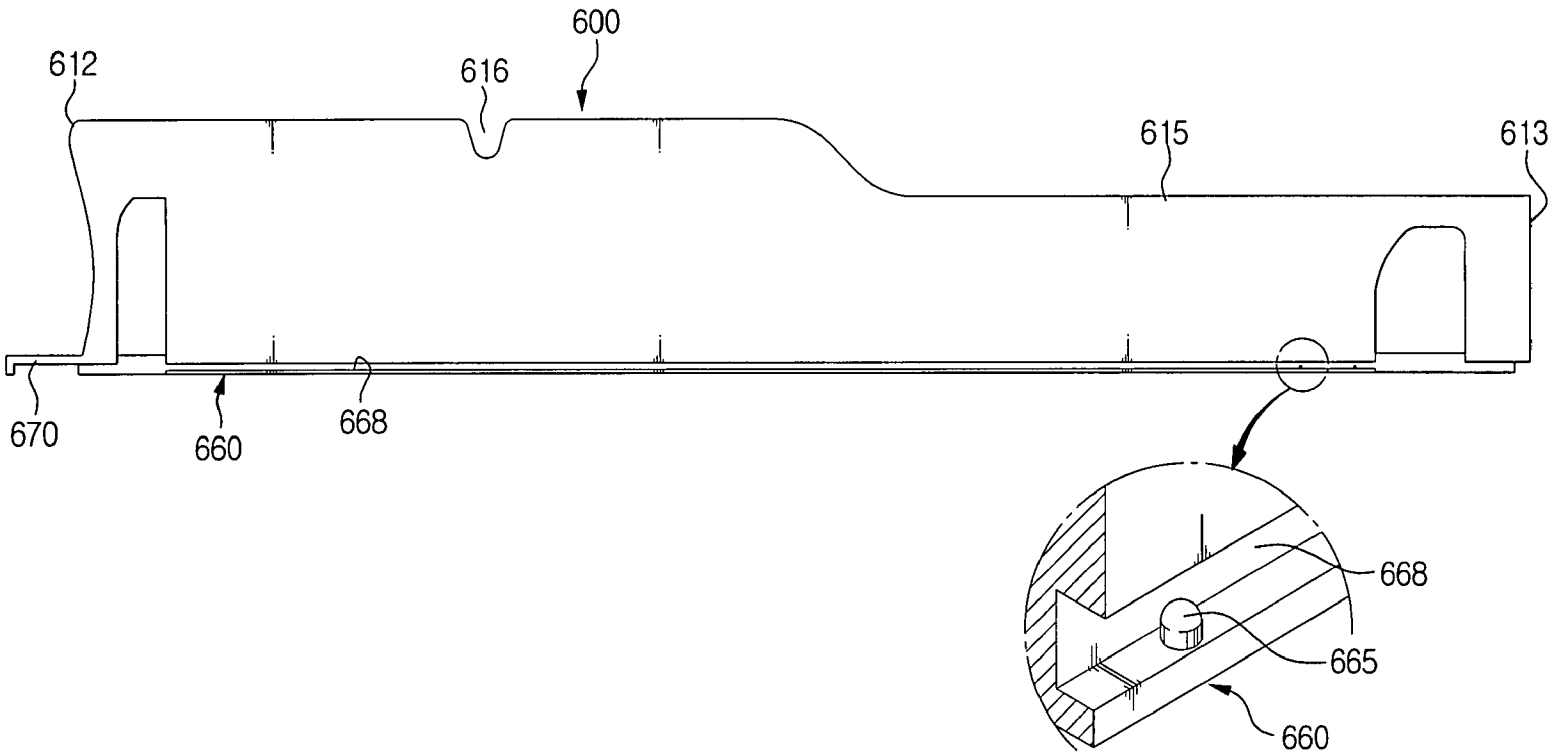
FIG. 9 is a side elevational view of the channel according to the third embodiment of the present invention.
Figure 10:
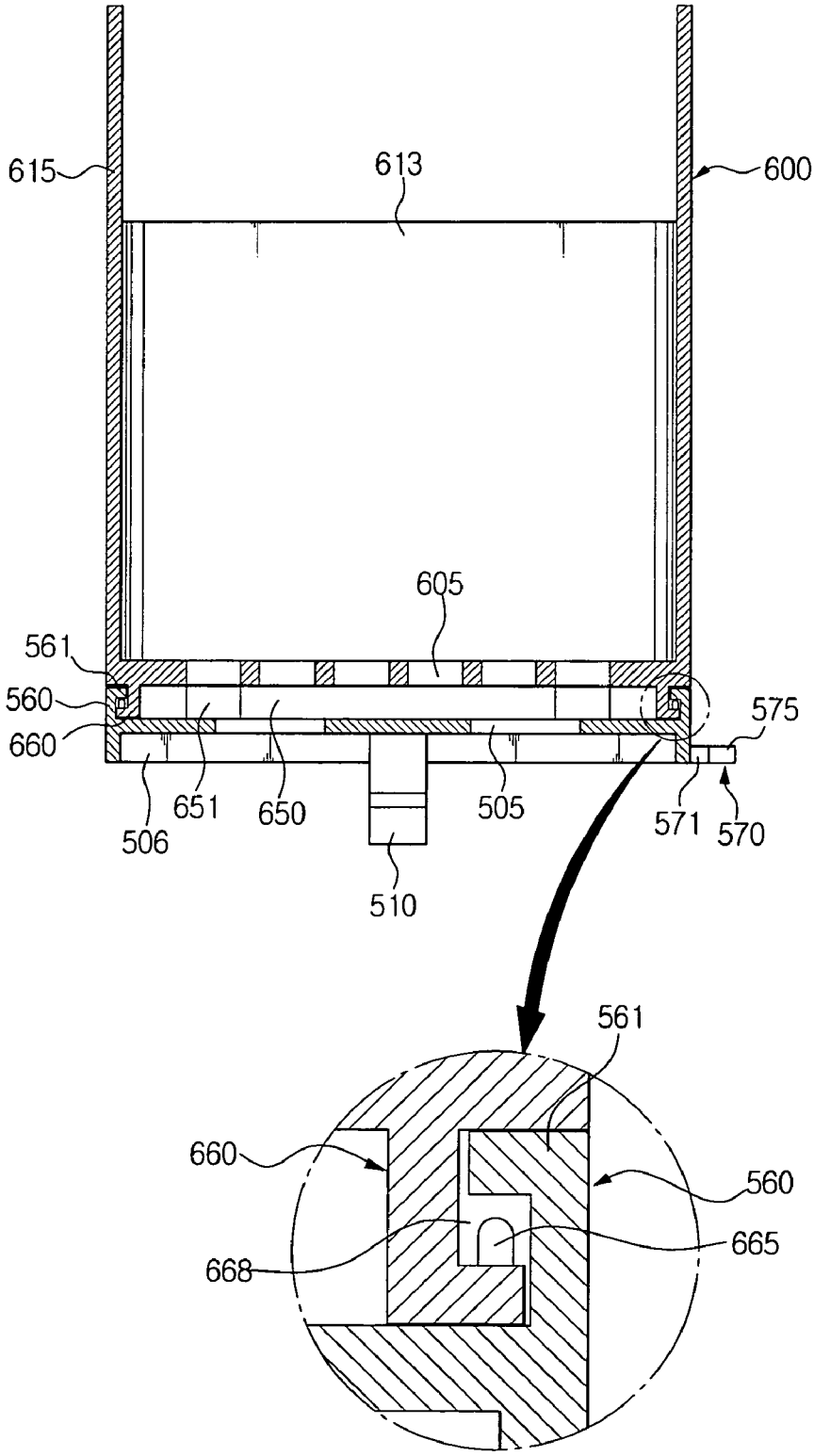
FIG. 10 is a cross sectional view, taken along A-A of FIG. 8.

As shown in FIGS. 8 to 10, a channel tray 600 has a pair of guide grooves 660 extended downwardly from both longitudinal side end portions of bottom surface of the channel tray 600. And a channel base 500 has a pair of guide rails 560 extended upwardly from both longitudinal side end portions of upper surface of the channel base 500. A guide groove 660 of a channel tray 600 has a longitudinal grooves 668 opened toward the longitudinal side end of the channel tray 600, and a guide rail 560 of a channel base 500 comprises a L shaped longitudinal projection 561 which are erected from longitudinal side end portions of the upper surface of the channel base 500 and bent inwardly of the channel base 500, so that longitudinal projections 561 are inserted into the longitudinal groove 668 of the guide groove slidably. Further, as shown in FIG. 10, the groove 668 of the guide groove 660 are wide enough to be engaged with the longitudinal projections 561 and also spacious enough to lift slightly up and down the channel tray 600 from the channel base 500 when the channel tray 600 is mounted on the channel base 500. The space between the guide groove 560 and the longitudinal projection 561 when engaged is determined by considering height of stoppers 550 of the channel base 500 as explained hereinafter.

As shown in FIG. 8, the channel base 500 has a pair of stoppers 550 protruded upwardly from the upper surface of the channel base 500 near its front end. And the channel tray 600 has a plurality of reinforcement members 650 vertically positioned against longitudinal sides of the bottom surface, and having approximately the same height as that of the stoppers 550. The reinforcement members 650 have a pair of passages 651 through which the stoppers 650 pass when the channel try 600 is pulled out or pushed onto the channel base 500. A front stopper 655 is positioned in front of the reinforcement members 650 near the front end of the channel tray 600. And at least one rear stopper 656 is positioned behind the reinforcements members 650 and at the rear portion of the channel try 600. The shape and height of front and rear stoppers 655 and 656 are identical or similar to that of the reinforcement member 650 except for passages 651 and are positioned in parallel with the reinforcement members 650.

Figure 12:
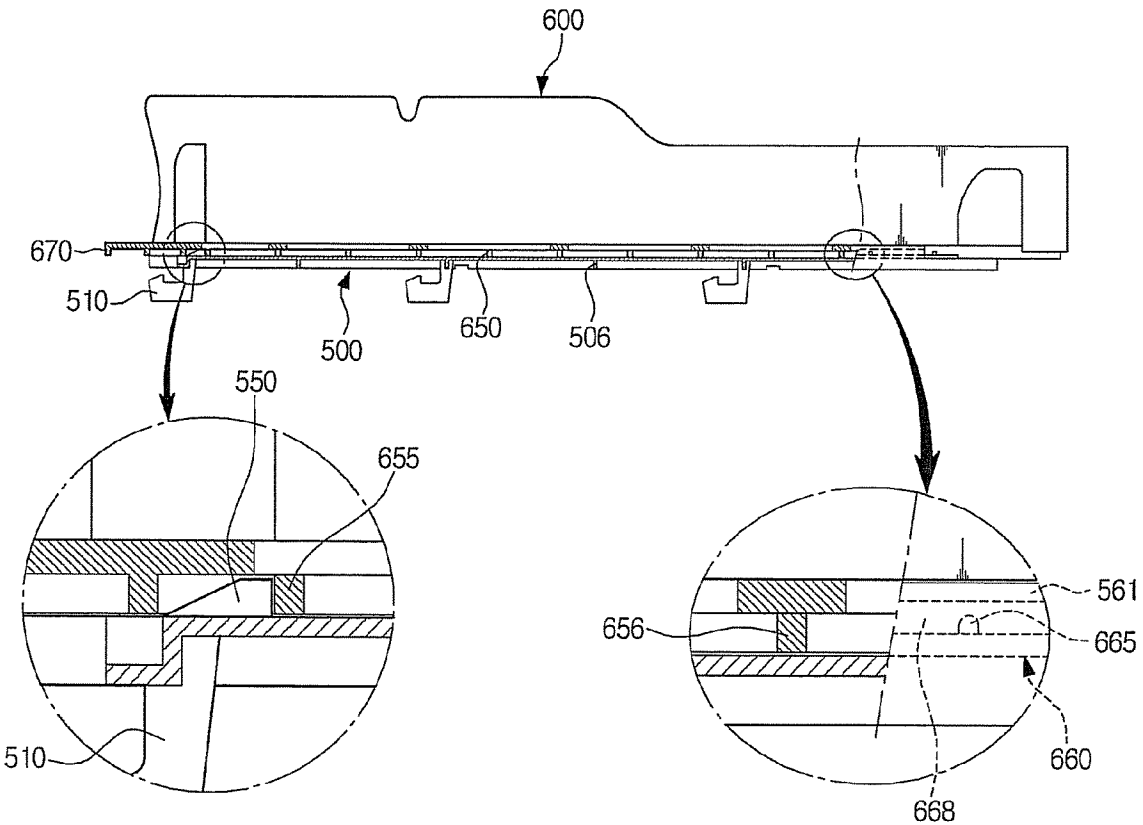
FIG. 12 is a partially sectioned side elevational view showing the displaying mode of the display rack module according to the third embodiment of the present invention.

When the channel tray 600 is mounted on the channel base 500 in the displaying mode, the front stopper 655 of the channel tray 600 abuts the stoppers 550 of the channel base 500 as shown in FIG. 12. And when the channel tray 600 is slid out forwardly from the channel base 500 in the refilling mode, the rear stopper 656 of the channel tray 600 abuts the stoppers 550 of the channel base 500 as shown in FIG. 13.

Figure 13:
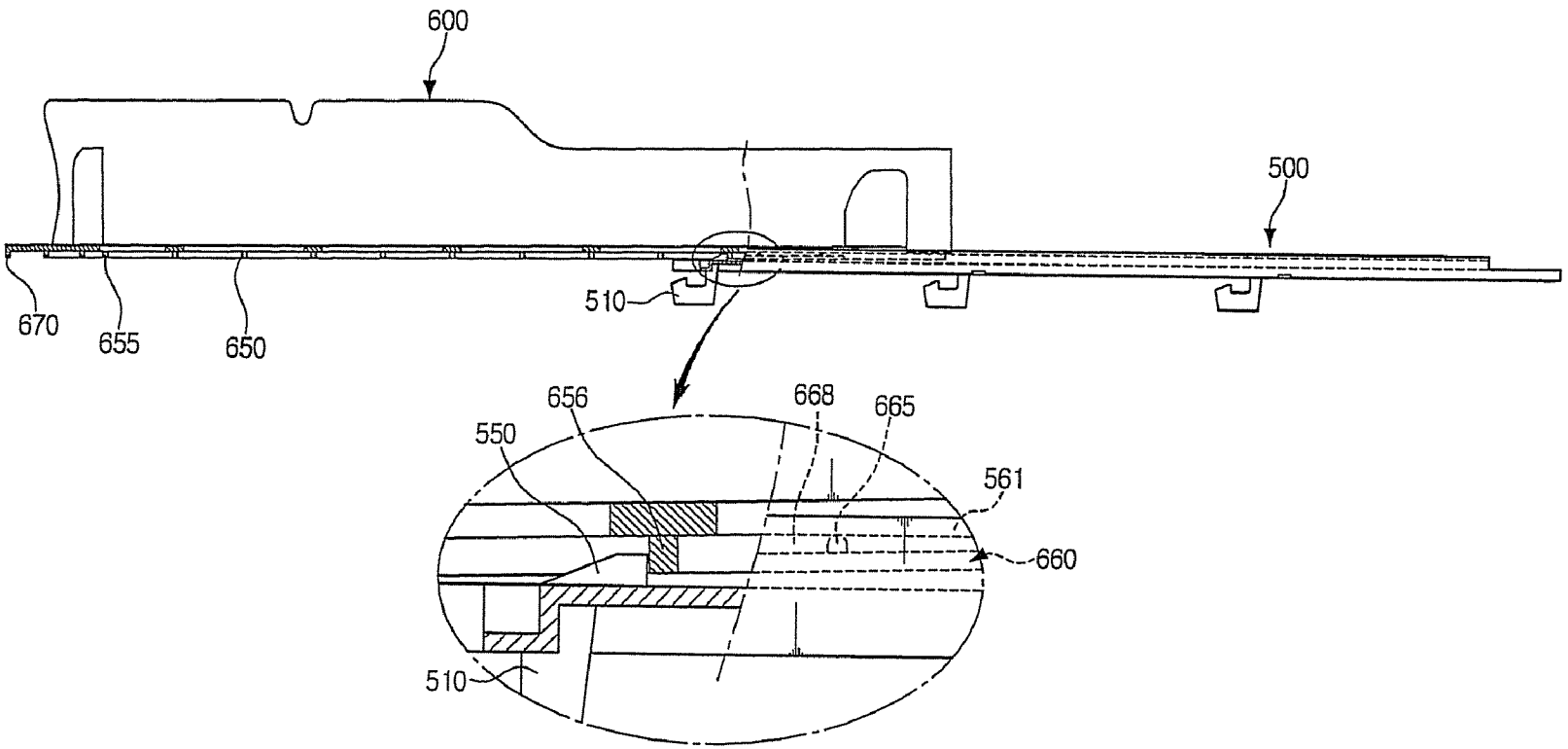
FIG. 13 is a partially sectioned side elevational view showing the refilling mode of the display rack module according to the third embodiment of the present invention.

In order to prevent the channel tray from being dropped out of the channel base 500 in the refilling mode, at least one projection 665 is protruded from the guide groove 660 vertically against the longitudinal projection 561 and is positioned behind the rear stopper 656 to occupy the space between the longitudinal projection 561 and the groove 668 as shown in FIGS. 12 and 13. However, the projection 665 has a round top end and/or does not contact the longitudinal protrusion 561 with tiny clearance therebetween in the groove 668 in order to allow lifting up of the front end of the channel tray 600 on the channel base 500 and to reduce friction upon sliding into and out of the channel tray 600 on the channel base 500. Without such projections, the channel tray 600 may drop out of the channel base 500 in refilling mode. In refilling mode, the front end of the channel tray 600 tends to fall down on its front end and its rear portion tends to be lifted up. Then, the rear stopper 656 may be disengaged from the stopper 550 of the channel base.

The channel tray 600 can be slid out from the channel base 500 when lifting up the front end of the channel tray 600 slightly in order to disengage the front stopper 655 from the stoppers 550 of the channel base 500. Then, the channel tray 600 is slid out to a distance where the rear stopper 656 abuts the stoppers 550 of the channel base 500. In the refilling mode, disengagement of the rear stopper 656 from the stoppers 550 is prevented by the projections 665 which occupy the space between the longitudinal protrusions 561 and the grooves 668. The traveling distance is determined by the distance between the front stopper 655 and the rear stopper 656 of the channel tray 600.

Further, Embodiment 3 provides another structure for fixing the channel base 500 on the lateral wires of the display case in place of grooves 110 and 310, bolt holes 120, 130, 140, 320, 330 and 340 and bolts/nuts in the Embodiments 1 and 2. As shown clearly in FIG. 11, the channel base 500 has at least two hooks 510 which are extended downwardly from its bottom surface and are bent vertically toward the front end of the channel base 500. Alternatively, the hooks 510 may be bent toward the rear end of the channel base, too. The hook 510 is inserted into space between the lateral wires of the display case and fixed at a lateral wire. The number of hooks 510 is illustrated three in FIG. 11 for illustrational purpose, however, the number should be determined by considering locations of lateral wires of shelves or floors in the display case and also by considering size of the display rack module to be secured on the wires. The hooks 510 may be also used together with the grooves 110 and 310, bolt holes 120, 130, 140, 320, 330 and 340 and bolts/nuts explained with regard to the Embodiments 1 and 2

Further, Embodiment 3 shows another design of the front wall of the channel tray 600, As shown in FIG. 8, the channel tray 600 has an opening 611 on its front in place of the front wall 210 and 410 of Embodiments 1 and 2 in order to view substantially a lead article stocked in the channel 500. Then the knob 670 is extended forwardly from the lower end or bottom of the opening 611. It is desirable that the opening 611 should have a pair of supporting lips 612 extended inwardly from both of the upper portions of the opening 611 in order to support and prevent the lead article from being dropped out of the opening 611. The rear wall 613 of the Embodiment 3 has a contour wall which fits to or has slightly larger diameter than the shape of the article. These front wall and rear wall structure of the Embodiment 3 may be also applied to the Embodiments 1 and 2 without further modification.

Figure 11:
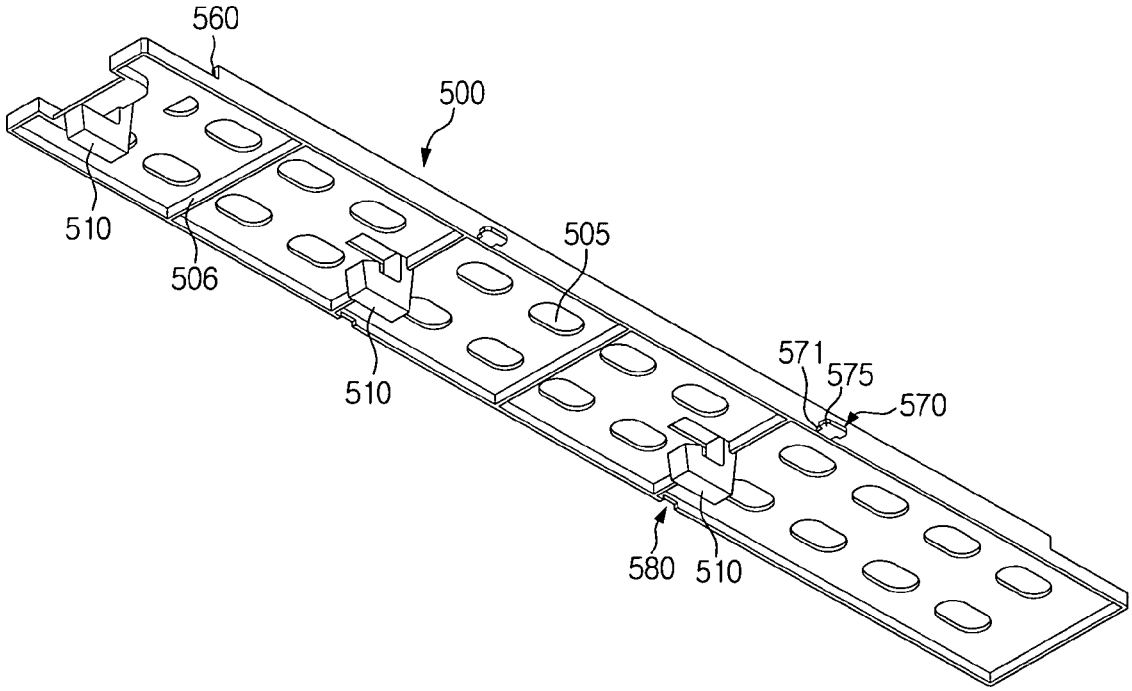
FIG. 11 is a perspective view of the channel base according to the third embodiment of the present invention.

Further, as shown in FIGS. 8, 10 and 11, Embodiment 3 suggests another structure for keys 570 and key holes 580 of the channel base 500 by simplifying the keys 170 and 370 and the key holes 180 and 380. The key 570 is a planar member which has a laterally extended linear portion 571 and then an enlarged portion 575 at the free end. And the key hole 580, which is formed at the opposite side member of the channel base 500, has a rectangular groove to be fitted with the linear portion 571 of the key 570. These keys 570 and key holes 580 are also applicable to the Embodiment 1 and 2.

Display racks according to the present invention are explained on basis of modular construction. However, a display rack may comprise a common base(s) and a plurality of slidable channel trays 200, 400 and 600. The common base(s) has at least two channels, each of which corresponds to a channel base 100, 300 and 500. Further, the common base may have smaller numbers of bolt holes or hooks for being fixed on the wires of the display case than those of channel bases 100, 300 and 500 in the modular construction.

The display rack module and the display rack described above provide a display rack in which channel trays can be slid out forwardly from the display rack so that the new articles can be refilled easily behind the old articles.

Although the present invention has been described in connection with preferred embodiments thereof, many variations and modifications will now become apparent to those skilled in the art. Therefore, the present invention should be limited not by the specific disclosure herein, but only by the appended claims.

What is claimed is:

1. A display rack module comprising:

a channel base including an upper surface, longitudinal sides and a bottom surface to be fixed on a wire shelf of a display case, and a channel tray including at least a front wall, side walls and a bottom defined by a front end, longitudinal sides and a rear end for holding articles therein, and mounted slidably on the channel base to be slid out forwardly from the channel base in a refilling mode and returned backwardly onto the channel base in a displaying mode, wherein said channel tray further includes:

a pair of guide grooves extended downwardly along the longitudinal sides of the bottom, and opened outwardly from the longitudinal sides of the bottom, respectively;

a front stopper and a rear stopper which are protruded downwardly from the bottom in parallel with each other between and across the pair of guide grooves, with the front stopper positioned at the front end of the bottom and the rear stopper positioned near the rear end of the bottom, wherein said channel base further includes:

a pair of L shaped longitudinal projections which are erected from longitudinal sides of the channel base and bent inwardly to be inserted into the guide grooves of said channel tray, respectively; and at least one stopper protruded upwardly at a front of the upper surface, which contacts with the front stopper of said channel tray in the displaying mode and contacts with the rear stopper of said channel tray in the refilling mode, and wherein said channel tray further includes at least one projection, respectively, which is positioned behind the rear stopper and protruded upwardly against the L shaped longitudinal projection of said channel base in the guide groove in order to prevent said channel tray from being dropped out of said channel base in the refilling mode.

2. The display rack module as claimed in claim 1, wherein said channel tray further includes a plurality of reinforcement members formed downwardly between and across the pair of guide grooves, in parallel with the front and rear stoppers, and positioned from behind the front stopper to the rear end of the bottom, and the reinforcement members formed between the front stopper and the rear stopper have at least a passage through which the stopper of said channel base passes when said channel tray is slid out forwardly from said channel base in the refilling mode and returned backwardly onto said channel base in the displaying mode.

3. The display rack module as claimed in claim 1, wherein said channel tray further includes:

an opening at the front wall to view a lead article, the opening defined by a pair of supporting lips extended respectively from upper parts of the side walls of the channel tray; and a knob extended forwardly from the front end of the bottom.

4. The display rack module as claimed in claim 1, wherein said channel base further includes at least a key and a key-hole at the longitudinal sides respectively, and said channel tray further includes at least a groove at a top of the side walls to be mated with the key of said channel base.

5. The display rack module as claimed in claim 1, wherein said channel base further includes at least two hooks which are extended downwardly from the bottom surface and are bent toward the front of said channel base.

6. A display rack comprising a plurality of display rack modules as claimed in claim 1 connected with each other laterally side-by-side to be fixed on wire shelves in the display case.

* * * * *